US007174572B1

(12) United States Patent
Diamond et al.

(10) Patent No.: US 7,174,572 B1
(45) Date of Patent: Feb. 13, 2007

(54) HEADWEAR WITH STRETCHABLE SWEATBAND

(75) Inventors: Steven S Diamond, Hillsboro, OR (US); Richard Luiz Franca, Portland, OR (US)

(73) Assignee: Nike, Inc., Beaverton, OR (US)

( * ) Notice: Subject to any disclaimer, the term of this patent is extended or adjusted under 35 U.S.C. 154(b) by 406 days.

(21) Appl. No.: 10/601,334

(22) Filed: Jun. 20, 2003

(51) Int. Cl.
*A42C 5/00* (2006.01)

(52) U.S. Cl. ..... 2/181

(58) Field of Classification Search ..... 2/181, 2/195.1
See application file for complete search history.

(56) References Cited

U.S. PATENT DOCUMENTS

| | | | | | |
|---|---|---|---|---|---|
| 246,588 | A | * | 9/1881 | Bancroft | 2/181 |
| 1,511,129 | A | | 10/1924 | McKnight | |
| 1,674,361 | A | | 6/1928 | Gstalder | |
| 2,052,123 | A | | 8/1936 | Adamson | 2/195 |
| 2,377,933 | A | | 6/1945 | Glass | 154/2 |
| 2,544,798 | A | | 3/1951 | Lippmann | 2/181 |
| 2,820,226 | A | | 1/1958 | Topiel et al. | 2/181 |
| 3,089,146 | A | * | 5/1963 | Sterne | 2/181 |
| 3,309,713 | A | | 3/1967 | Kaufman | 2/183 |
| 4,656,671 | A | * | 4/1987 | Manges | 2/174 |
| 4,815,148 | A | | 3/1989 | Satterfield | 2/197 |
| 5,031,246 | A | | 7/1991 | Kronenberger | 2/197 |
| 5,033,122 | A | * | 7/1991 | Smith | 2/209.3 |
| 5,272,772 | A | | 12/1993 | Hahn | 2/195.2 |
| 5,317,761 | A | * | 6/1994 | Piche | 2/181 |
| 5,488,740 | A | | 2/1996 | Garza | 2/175.1 |
| 5,566,395 | A | | 10/1996 | Nebeker | 2/181 |
| 5,615,415 | A | | 4/1997 | Beckerman | 2/195.3 |
| 5,632,046 | A | | 5/1997 | Green et al. | 2/183 |
| 5,715,540 | A | | 2/1998 | Cho | 2/195.3 |
| 5,926,850 | A | | 7/1999 | Han | 2/183 |
| 5,956,773 | A | | 9/1999 | LaMantia | 2/195.1 |
| 5,966,742 | A | | 10/1999 | Cunliffe | 2/195.3 |
| 5,983,398 | A | | 11/1999 | Kronenberger | 2/181 |
| 6,006,362 | A | * | 12/1999 | Walsh | 2/209.13 |
| 6,016,572 | A | | 1/2000 | Park | 2/195.2 |
| 6,052,831 | A | | 4/2000 | Park | 2/195.2 |
| 6,067,658 | A | | 5/2000 | Cho | 2/181 |
| 6,119,273 | A | | 9/2000 | Cho | 2/195.3 |
| 6,122,774 | A | | 9/2000 | Park | 2/181 |
| 6,199,213 | B1 | * | 3/2001 | Whang | 2/181 |
| 6,347,410 | B1 | | 2/2002 | Lee | 2/181 |
| 6,477,715 | B2 | * | 11/2002 | Shin | 2/181.4 |
| 6,502,245 | B1 | | 1/2003 | McBride | 2/181 |
| 6,928,659 | B2 | * | 8/2005 | Lee | 2/175.1 |
| 6,982,398 | B2 | * | 1/2006 | Albrecht | 219/133 |
| 2003/0037365 | A1 | * | 2/2003 | Wilson | 2/181 |
| 2003/0172438 | A1 | * | 9/2003 | Han et al. | 2/181 |

FOREIGN PATENT DOCUMENTS

| | | |
|---|---|---|
| WO | WO 01/05259 A1 | 1/2001 |

* cited by examiner

*Primary Examiner*—Katherine Moran
*Assistant Examiner*—Richale L. Haney
(74) *Attorney, Agent, or Firm*—Banner & Witcoff, Ltd.

(57) ABSTRACT

An article of headwear having an adjustable configuration includes a crown portion and a sweatband secured to a peripheral edge of the crown. The sweatband includes an inner piece of stretchable fabric material folded about itself such that opposing longitudinal edges of the inner piece are proximate one another to form a seam, and a binding of elastic material secured to the inner piece such that it covers the seam. The inner piece may be wrapped about a filler piece of stretchable fabric.

49 Claims, 5 Drawing Sheets

HEADWEAR WITH STRETCHABLE SWEATBAND

FIELD OF THE INVENTION

This invention relates generally to headwear, and, in particular, to headwear having a stretchable sweatband to adapt to various head sizes.

BACKGROUND OF THE INVENTION

Headwear can come in many forms including hats, caps, bucket style, visors, etc. Such headwear, including baseball caps, for example, may be classified as either fitted or adjustable. Fitted headwear is generally manufactured in a wide range of sizes, with each size having a fixed circumference to accommodate an individual with a corresponding head circumference. Adjustable headwear may incorporate an adjustment system that permits a single article of headwear to accommodate individuals with various head dimensions. Accordingly, a manufacturer can produce a line of adjustable headwear with significantly fewer sizes than a corresponding line of fitted headwear, since each adjustable headwear article can accommodate a range of sizes rather than a particular size. Although adjustable headwear is generally more complex to manufacture than fitted headwear, the manufacturing efficiency of producing relatively few sizes reduces the overall cost of adjustable headwear in comparison with fitted headwear. In addition, a retailer can carry a line with fewer articles of headwear, thereby realizing reduced handling and inventory costs.

A baseball cap having a conventional style of adjustment system is disclosed in U.S. Pat. No. 5,272,772 to Hahn. A rear portion of the baseball cap includes a cutout area and two overlapping straps that extend into the cutout area. One of the straps includes a plurality of protrusions and the other strap includes a plurality of corresponding apertures. By snapping the protrusions into different apertures, the circumference of the baseball cap can be adjusted. A similar adjustment system is disclosed in U.S. Pat. No. 4,815,148 to Satterfield, and incorporates portions of a hook and loop fastener that are located on opposite sides of a slit formed in the baseball cap.

A drawback to the baseball caps of Hahn and Satterfield relates to the aesthetic appearance of the adjustment system. The material forming the crown of fitted baseball caps extends entirely around the head. In contrast, the material forming the crown of the baseball caps of Hahn and Satterfield includes the cutout area and slit, respectively, which breaks the continuity of the crown. Accordingly, manufacturers often incorporate an adjustment system into baseball caps that provides the appearance of a fitted baseball cap. For example, U.S. Pat. No. 6,122,774 to Park; U.S. Pat. No. 5,715,540 to Cho; and U.S. Pat. No. 5,615,415 to Beckerman each disclose adjustable baseball caps that incorporate a stretchable material. U.S. Pat. No. 5,031,246 to Kronenberger discloses an adjustable baseball cap that incorporates an inflatable bladder located within material that forms the bottom of the crown to vary the effective diameter of a headband in the crown.

Problems associated with many prior art adjustable headwear include complex construction and excessively bulky sweatbands. It is an object of the present invention to provide an article of headwear that reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The present invention is directed to an article of headwear that has an adjustable configuration to accommodate a range of head sizes, thereby reducing the number of articles of headwear required to fit various individuals as compared to the number of fixed size articles of headwear required to fit those same individuals.

In accordance with a first aspect, an article of headwear having an adjustable configuration includes a crown portion and a sweatband secured to a peripheral edge of the crown. The sweatband includes an inner piece formed of stretchable fabric material folded about itself such that opposing longitudinal edges of the inner piece are proximate one another to form a seam. A binding of elastic material is secured to a side of the inner piece having the seam.

In accordance with another aspect, an article of headwear having an adjustable configuration includes a plurality of gores forming a crown and a sweatband secured to a peripheral edge of the crown. The sweatband includes a filler piece of elastic material and an inner piece of stretchable fabric material folded about the filler piece of elastic material such that opposed longitudinal edges of the inner piece are proximate one another to form a seam. A binding of elastic material is secured to a side of the inner piece having the seam.

In accordance with a further aspect, an article of headwear having an adjustable configuration includes a crown formed of a plurality of gores. The gores are formed of a stretchable material. A bill is secured to the crown. A sweatband is secured to a peripheral edge of the crown. The sweatband includes a filler piece of elastic material and an inner piece of stretchable fabric material folded about the filler piece such that opposed longitudinal edges of the inner piece abut one another to form a seam. A binding of elastic material is sewn to a side of the inner piece having the seam.

Substantial advantage is achieved by providing an article of headwear with a stretchable headband. In particular, an adjustable article of headwear that can accommodate multiple head sizes can be produced with a simple construction and minimal bulk. These and additional features and advantages of the invention disclosed here will be further understood from the following detailed disclosure of certain preferred embodiments.

Figure 1:
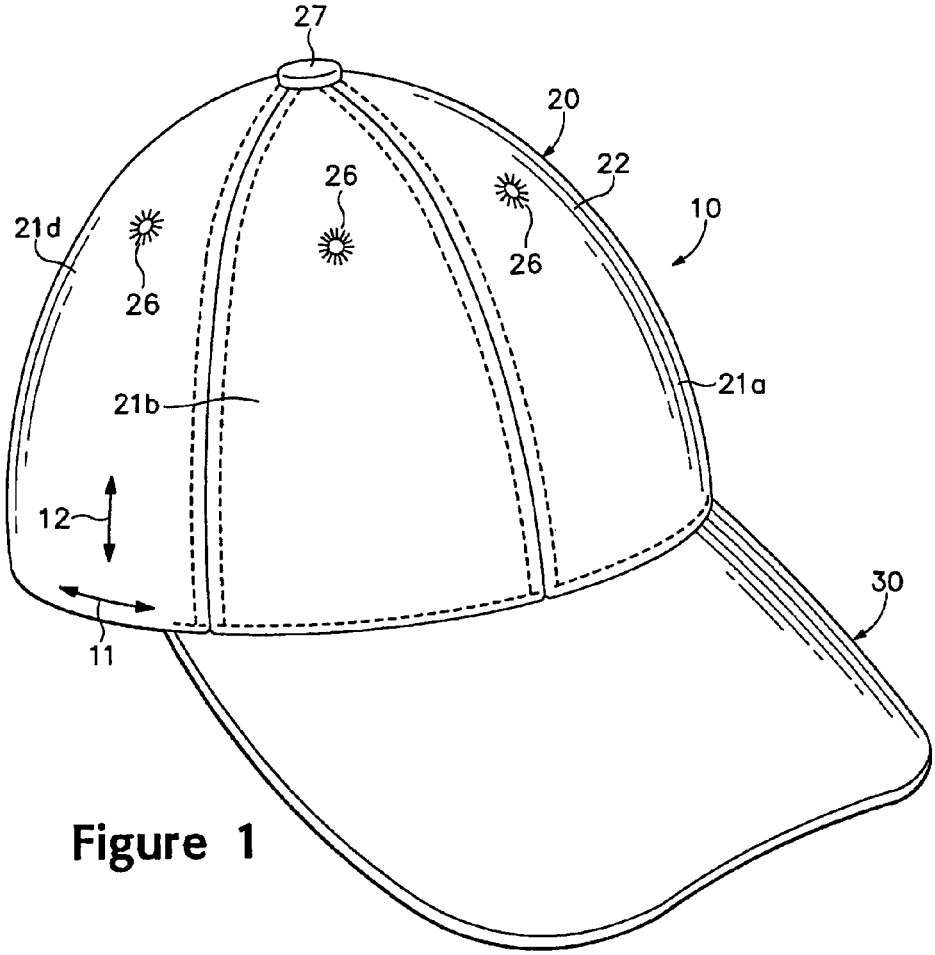
FIG. 1 is a perspective view of an article of headwear in accordance with the present invention.

The figures referred to above are not drawn necessarily to scale and should be understood to present a representation of the invention, illustrative of the principles involved. Some features of the article of headwear depicted in the drawings have been enlarged or distorted relative to others to facilitate explanation and understanding. The same reference numbers are used in the drawings for similar or identical components and features shown in various alternative embodiments. Articles of headwear with a stretchable headband as disclosed herein will have configurations and components determined, in part, by the intended application and environment in which they are used.

DETAILED DESCRIPTION OF CERTAIN PREFERRED EMBODIMENTS

The following discussion and accompanying figures disclose an article of headwear having a stretchable configuration in accordance with the present invention. In the embodiments discussed herein, the article of headwear is disclosed as having the structure of a baseball cap and may be referred to herein as a hat. The concepts and features disclosed in the following discussion may, however, be applied to a wide range of headwear to impart a stretchable configuration that accommodates the head circumference of different individuals. Accordingly, the present invention is not limited to any particular type of headwear, but may be applied to a wide range of headwear, including, e.g., hats, caps, bucket style, and visors.

Figure 2:
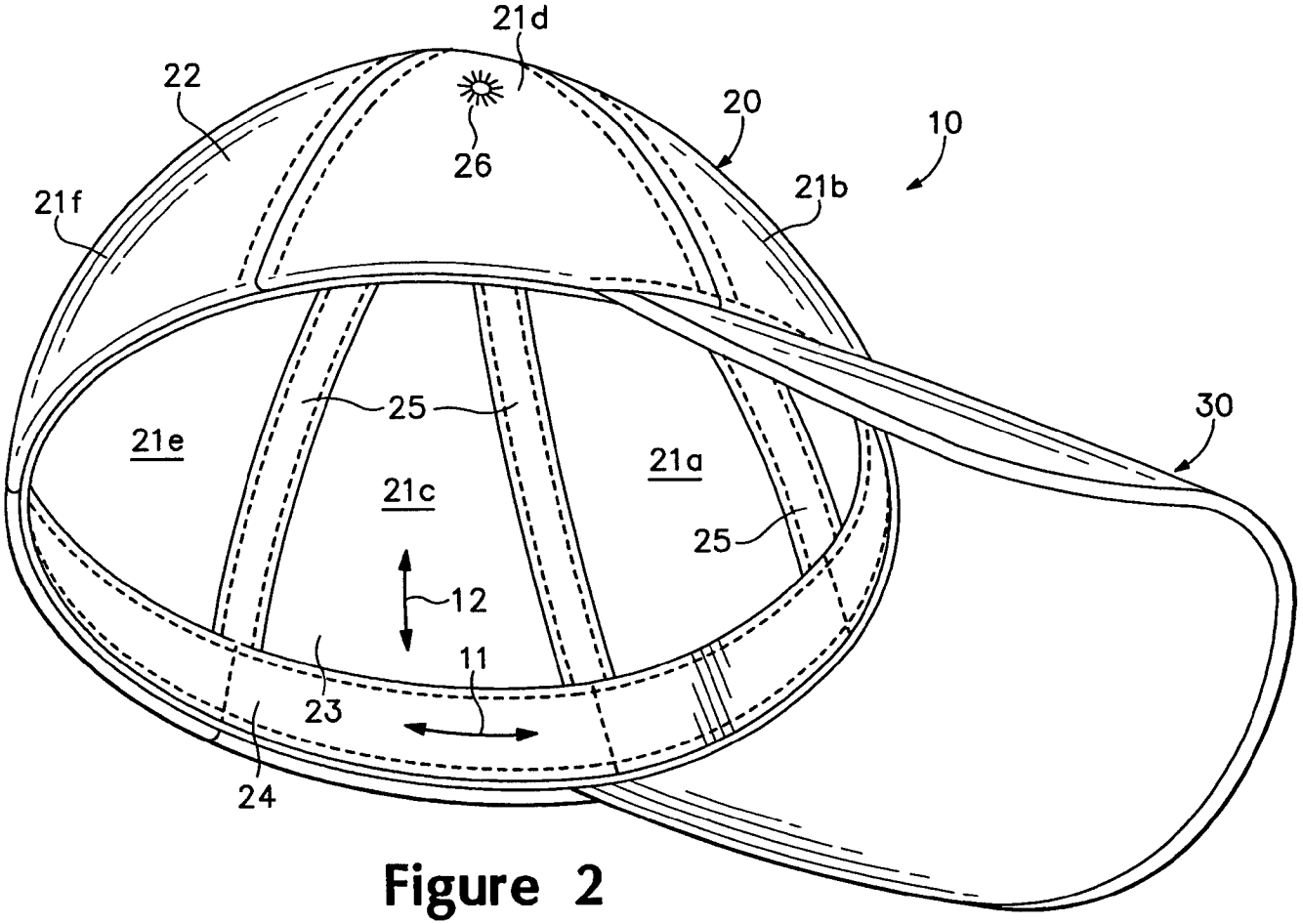
FIG. 2 is another perspective view of the article of headwear of FIG. 1, showing an interior of the article of headwear.

The present invention may be embodied in various forms. A preferred embodiment of an article of headwear or hat 10 is depicted in FIGS. 1–2 and includes two principal elements; a crown portion 20 and a visor or bill portion 30. Crown portion 20 forms a generally hemispherical covering for a head of an individual, and bill portion 30 extends outward in a generally horizontal direction from crown portion 20 to shade the face and eyes of an individual. The materials forming crown portion 20 extend entirely around a circumference of the wearer's head to provide hat 10 with the appearance of a fitted baseball cap that accommodates an individual with a specific head circumference. Hat 10, however, incorporates an adjustment system that provides a stretchable configuration to accommodate the head circumferences of different individuals, as will be described in greater detail below.

Crown portion 20 includes a plurality of panels, commonly referred to as gores, 21*a*–21*f* that are attached together along abutting sides thereof. More specifically, crown portion 20 includes two front gores 21*a* and 21*b* that are located adjacent to bill portion 30, two side gores 21*c* and 21*d* that are located on a left side and a right side of hat 10, respectively, and two rear gores 21*e* and 21*f* that are located in a rear area of hat 10. The various gores 21*a*–21*f* define an exterior surface 22 and an opposite interior surface 23 of crown portion 20.

In a preferred embodiment, gores 21*a*–21*f* are formed of a stretchable material that will deform in the presence of a tensile force to accommodate the head circumferences of different individuals. The material forming gores 21*a*–21*f* may be any generally planar material with the ability to substantially return to an original size and shape following tensile deformation. After being stretched to a reasonable degree, therefore, the material forming gores 21*a*–21*f* is capable of substantially returning to an unstretched configuration. In other preferred embodiments, gores 21*a*–21*f* are formed of a non-stretchable material.

Various materials are suitable for gores 21*a*–21*f*, including polymer, synthetic textile, and natural textile materials, including, e.g., polyesters, cottons, woven and non-woven materials. In order to enhance the stretch properties of gores 21*a*–21*f*, the material may incorporate various elastomeric fibers, such as elastane, which is manufactured under the LYCRA® trademark by E.I. duPont de Nemours and Company. Another suitable material is stretchable cotton twill having between 2 and 5% spandex fibers. In certain embodiments, suitable materials for gores 21*a*–21*f* will have a stretch that ranges at least from 2 to 5%, but the degree of stretch may vary significantly depending upon the specific structure of the various gores 21*a*–21*f* and other factors related to hat 10.

Although head dimensions may vary in many respects, the circumference of the head is the specific head dimension that regularly determines whether a particular hat is properly fitted. Accordingly, the circumference of crown portion 20 is a factor in determining whether hat 10 properly fits upon a head. Referring to FIGS. 1 and 2, a first arrow 11 and a second arrow 12 are depicted for reference on crown portion 20. First arrow 11 extends in a horizontal direction and generally corresponds with a circumference of crown portion 20, whereas second arrow 12 extends in a vertical direction. By orienting the material forming gores 21*a*–21*f* such that a direction of stretch is substantially aligned with first arrow 11, crown portion 20 adjusts circumferentially to accommodate the head circumferences of different individuals. That is, stretching of the material in a direction of first arrow 11 modifies the circumference of crown portion 20 in a manner that corresponds with a circumference of the head.

In addition to gores 21*a*–21*f*, crown portion 20 may include a plurality of sections of seam tape 25, a plurality of apertures 26, and a button 27. Seam tape 25 is secured to interior surface 23 and covers the seams between gores 21*a*–21*f*. One of apertures 26 is formed in each of gores 21*a*–21*f* to enhance the transfer of air through crown portion 20. Button 27 is positioned on a top portion of crown portion 20 to mask the area where gores 21*a*–21*f* converge.

As seen in FIG. 2, a peripheral edge of a sweatband 24 is secured to a lower peripheral edge of crown portion 20 and folded upward into the interior of crown portion 20.

Figure 3:
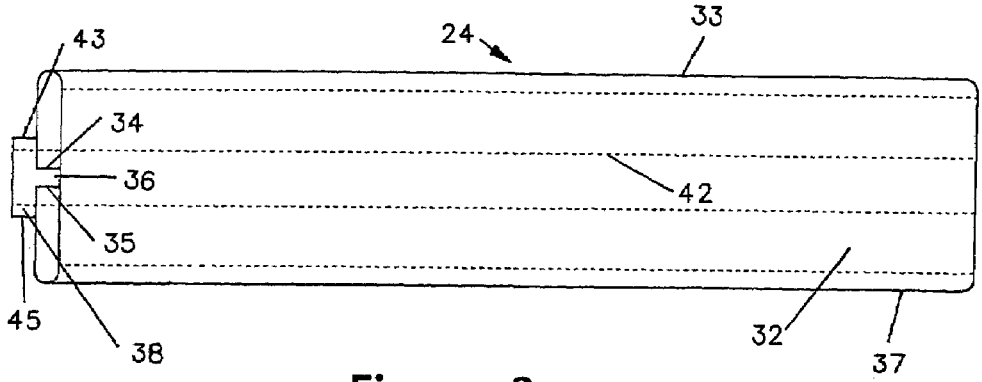
FIG. 3 is a perspective view of an embodiment of the sweatband of the article of headwear of FIG. 1.

A preferred embodiment of sweatband 24 is shown in FIG. 3 in exploded form. Sweatband 24 is formed of an elongate inner piece 32, having opposed longitudinal edges 34, 35 that are folded over onto an outer surface of inner piece 23 to a point proximate one another to form a seam 36. Once longitudinal edges 34, 35 are folded over close to one another, longitudinal folded edges 33, 37 are formed along the length of inner piece 32.

The terms "inner" and "outer" are used herein to refer to directions with respect to the interior and exterior, respectively, of hat 10. Thus, an inner portion of sweatband 24 is a portion that is positioned toward the interior of hat 10, and the innermost portion of sweatband 24 will be in contact with a wearer's head. Accordingly, "outer" refers to a portion of sweatband 24 toward the exterior of hat 10, and the outermost portion of sweatband 24 will be in contact with crown portion 20 when sweatband 24 is in its final position secured to crown portion 24.

Inner piece 32 is formed of a material that is stretchable in order to deform in the presence of a tensile force to accommodate individuals with various head dimensions. The material forming inner piece 32 may be any generally planar material with the ability to substantially return to an original size and shape following tensile deformation. After being stretched to a reasonable degree, therefore, inner piece 32 is capable of substantially returning to an unstretched configuration. Inner piece 23 may be cut in a bias direction, or in a normal direction.

Various materials are suitable for inner piece 32, including polymer, synthetic textile, and natural textile materials. In certain embodiments, inner piece 32 may be formed of a combination of stretchable cotton twill and spandex. In a preferred embodiment, inner piece 32 is formed of approximately 94% cotton and approximately 6% spandex. In another preferred embodiment, inner piece 23 is formed of approximately 100% polyester.

Figure 4:
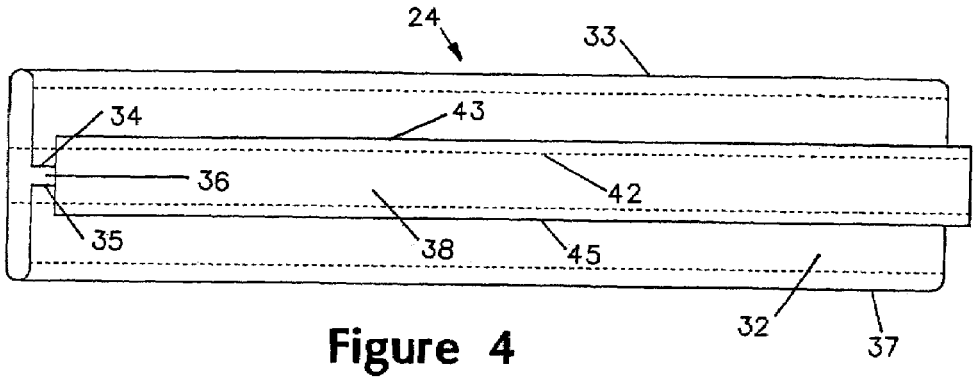
FIG. 4 is another perspective view of the sweatband of FIG. 3.
Figure 5:
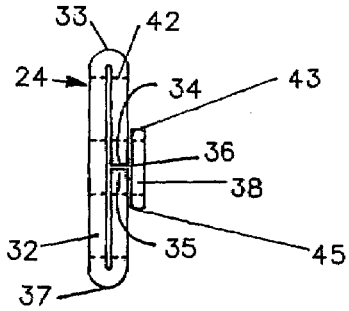
FIG. 5 is a side elevation view of the sweatband of FIG. 3.

A binding 38 is secured to an outer side of inner piece 32, the side having seam 36. In certain preferred embodiments, binding 38 is secured to inner piece 32 so as to cover seam 36. It is to be appreciated that in certain embodiments, binding 38 may be positioned above or below seam 36. It is also to be appreciated that the width of binding 38 may vary. For example, binding 38 may be as wide as inner piece 32, or, as seen in the embodiment shown in FIGS. 3–5, may be significantly narrower than inner piece 32. Binding 38 is formed of an elastic material that will elastically stretch and is capable of substantially returning to its original configuration. Binding 38 may be cut in a bias direction, or in a normal direction.

Various elastic materials are suitable for binding 38. In one preferred embodiment, binding 38 is formed of elastane. In another preferred embodiment, binding 38 is formed of approximately 60% nylon and approximately 40% rubber. Opposed longitudinal edges 43, 45 of binding 38 may be machined edges in certain preferred embodiments. In other preferred embodiments, opposed longitudinal edges 43, 45 may be folded under binding 38 in known fashion before binding 38 is secured to inner piece 23.

In a preferred embodiment, stitching 42 is used to secure the folded portions of inner piece 32 to each other and binding 38 to inner piece 32. In a preferred embodiment four rows of stitching 42 are used, with a row extending substantially parallel to and proximate each of longitudinal edges 43, 45 of binding 38 and a row extending substantially parallel to and proximate each of longitudinal folded edges 33, 37 of inner piece 32. The row of stitching proximate longitudinal folded edge 37 also secures sweatband 24 to a lower peripheral edge of crown portion 20, as can be seen in FIG. 2. It is to be appreciated that four rows of stitching are not required to secure inner piece 32 together and binding 38 to inner piece 32, and that any number of rows of stitching is considered to be within the scope of the present invention.

Figure 9:
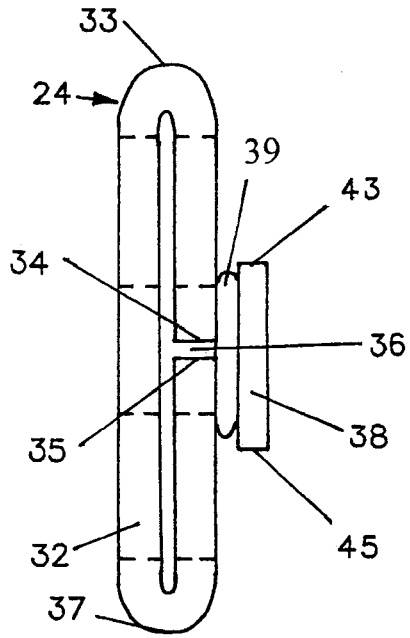
FIG. 9 is a side elevation view of another embodiment of the sweatband of FIG. 1, showing its binding adhesively secured to its inner piece.
Figure 10:
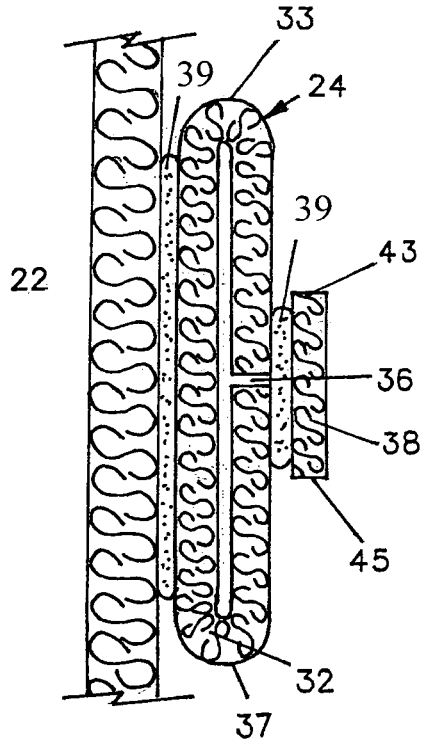
FIG. 10 is a section view, shown partially broken away, of another embodiment of the sweatband of FIG. 1, showing the sweatband adhesively secured to the crown portion of the article of headwear.

It is to be appreciated that other methods of securing binding 38 to inner piece 32, securing the folded longitudinal edges of inner piece 32 together, and securing sweatband 24 to crown portion 22 are considered to be within the scope of the invention. For example, the elements could be secured with adhesive, such as the SewFree® product supplied by Bemis Associates Inc. of Shirley, Mass. As seen in FIG. 9, binding 38 is secured to inner piece 32 with adhesive 39. As seen in FIG. 10, sweatband 24 is secured to crown portion 22 with adhesive 39.

Figure 6:
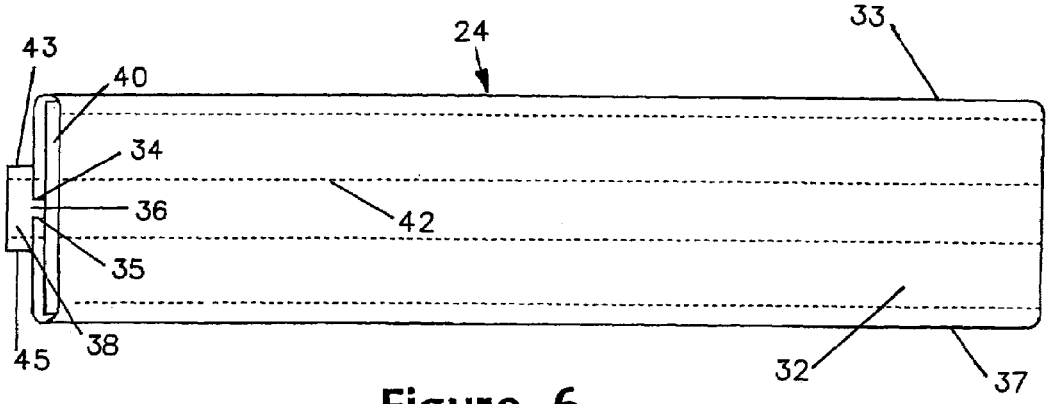
FIG. 6 is a perspective view of an alternative embodiment of the sweatband of the article of headwear of FIG. 1.
Figure 7:
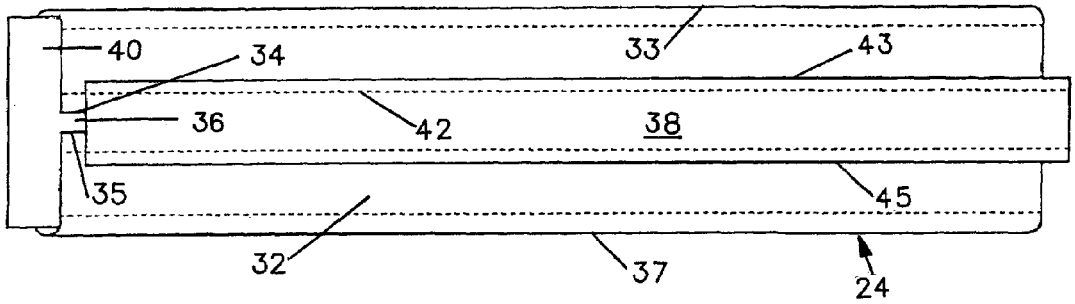
FIG. 7 is another perspective view of the sweatband of FIG. 6.
Figure 8:
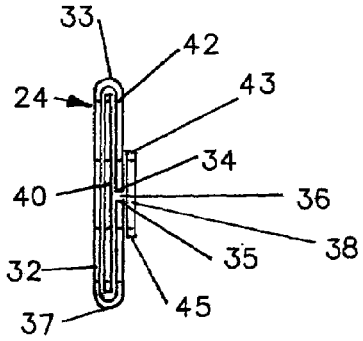
FIG. 8 is a side elevation view of the sweatband of FIG. 6.

In accordance with another preferred embodiment, as seen in FIGS. 6–8, inner piece 32 is folded about a filler piece 40. Filler piece 40 is preferably formed of an elastic material that will elastically stretch and is capable of substantially returning to its original configuration. Various elastic materials are suitable for filler piece 40 including, e.g., elastane. Filler piece 40 may be cut in a bias direction, or in a normal direction.

Each of gores 21*a*–21*f*, inner piece 32, filler piece 40, and binding 38 may be formed from a material with one-directional stretch to provide stretch in the direction of first arrow 11. That is, the material forming these elements may be selected to stretch in only a single direction. When manufacturing these elements from a material with one-directional stretch, care should be taken to ensure that the direction of stretch is generally aligned with the direction of first arrow 11. These elements may also be formed from a material with two-directional stretch, which provides stretch along the directions of both arrows 11 and 12. One skilled in the relevant art will recognize that materials with two-directional stretch generally appear to stretch in any direction along the plane of the material. Accordingly, the directions of stretch in a material with two-directional stretch need not necessarily be aligned with arrows 11 and 12, thereby simplifying the manufacturing process of these elements. When aligning the material relative to these elements, the direction of greatest stretch may be aligned with first arrow 11. Each of gores 21*a*–21*f*, inner piece 32, filler piece 40, and binding 38 may be formed of woven, non-woven, or knit fabrics.

By constructing sweatband 24 from stretchable inner piece 32 and elastic binding 38, and, optionally, elastic filler piece 40, a simple construction that effectively allows hat 10 to accommodate a range of head sizes can be realized.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of headwear having an adjustable configuration comprising, in combination:

a crown portion; and a sweatband secured to a peripheral edge of the crown, the sweatband comprising an inner piece formed of stretchable fabric material in an unfolded condition having opposed longitudinal edges and folded about itself such that the opposed longitudinal edges of the inner piece are proximate one another to form a seam; and a binding of elastic material secured to an outer side of the folded inner piece having the seam.

2. The article of headwear of claim 1, wherein the binding is secured to the inner piece with stitching.

3. The article of headwear of claim 2, wherein the stitching comprises a row of stitching extending substantially parallel to and proximate each of opposed longitudinal edges of the binding.

4. The article of headwear of claim 3, further comprising a row of stitching extending substantially parallel to and proximate each of longitudinal folded edges of the inner piece.

5. The article of headwear of claim 4, wherein the inner piece is secured to the crown portion with one of the rows of stitching extending substantially parallel to and proximate one of the longitudinal folded edges of the inner piece.

6. The article of headwear of claim 1, wherein the binding is secured to the inner piece with adhesive.

7. The article of headwear of claim 1, wherein the sweatband is secured to the crown with adhesive.

8. The article of headwear of claim 1, further comprising a bill secured to the crown portion.

9. The article of headwear of claim 1, wherein the inner piece is formed of cotton and spandex.

10. The article of headwear of claim 1, wherein the binding is formed of elastane.

11. The article of headwear of claim 1, wherein the inner piece is cut in a bias direction.

12. The article of headwear of claim 1, wherein the binding is cut in a bias direction.

13. The article of headwear of claim 1, wherein the crown portion is formed of a plurality of gores.

14. The article of headwear of claim 13, wherein the gores are formed of a stretchable fabric material.

15. The article of headwear of claim 14, wherein the stretchable fabric material is elastane.

16. The article of headwear of claim 1, wherein the binding of elastic material is secured to the inner piece such that it covers the seam.

17. An article of headwear having an adjustable configuration comprising, in combination:

a plurality of gores forming a crown; and a sweatband secured to a peripheral edge of the crown, the sweatband comprising a filler piece of elastic material;

an inner piece of stretchable fabric material in an unfolded condition having opposed longitudinal edges and folded about the filler piece of elastic material such that the opposed longitudinal edges of the inner piece are proximate one another to form a seam; and a binding of elastic material secured to a side of the folded inner piece having the seam.

18. The article of headwear of claim 17, wherein the binding is secured to the inner piece with stitching.

19. The article of headwear of claim 18, wherein the stitching comprises a row of stitching extending substantially parallel to and proximate each of opposed longitudinal edges of the binding.

20. The article of headwear of claim 19, further comprising a row of stitching extending substantially parallel to and proximate each of longitudinal folded edges of the inner piece.

21. The article of headwear of claim 20, wherein the inner piece is secured to the crown portion with one of the rows of stitching extending substantially parallel to and proximate one of the longitudinal folded edges of the inner piece.

22. The article of headwear of claim 17, wherein the binding is secured to the inner piece with adhesive.

23. The article of headwear of claim 17, wherein the sweatband is secured to the crown with adhesive.

24. The article of headwear of claim 17, further comprising a bill secured to the crown.

25. The article of headwear of claim 17, wherein the filler piece is formed of elastane.

26. The article of headwear of claim 17, wherein the binding is formed of elastane.

27. The article of headwear of claim 17, wherein the inner piece is formed of cotton and spandex.

28. The article of headwear of claim 17, wherein the inner piece is cut in a bias direction.

29. The article of headwear of claim 17, wherein the binding is cut in a bias direction.

30. The article of headwear of claim 17, wherein the gores are formed of a stretchable fabric material.

31. The article of headwear of claim 17, wherein the binding of elastic material is secured to the inner piece such that it covers the seam.

32. An article of headwear having an adjustable configuration comprising, in combination:

a crown formed of a plurality of gores, the gores being formed of a stretchable material;

a bill secured to the crown; and a sweatband secured to a peripheral edge of the crown, the sweatband comprising a filler piece of elastic material;

an inner piece of stretchable fabric material in an unfolded condition having opposed longitudinal edges and folded about the filler piece such that the opposed longitudinal edges of the inner piece abut one another to form a seam; and a binding of elastic material secured to a side of the folded inner piece having the seam.

33. The article of headwear of claim 32, wherein the filler piece is formed of elastane.

34. The article of headwear of claim 32, wherein the binding is formed of elastane.

35. The article of headwear of claim 32, wherein the inner piece is formed of cotton and spandex.

36. The article of headwear of claim 32, wherein the inner piece is cut in a bias direction.

37. The article of headwear of claim 32, wherein the binding is cut in a bias direction.

38. The article of headwear of claim 32, wherein the binding is secured to the inner piece with stitching.

39. The article of headwear of claim 38, wherein the stitching comprises a row of stitching extending substantially parallel to and proximate each of opposed longitudinal edges of the binding.

40. The article of headwear of claim 39, further comprising a row of stitching extending substantially parallel to and proximate each of longitudinal folded edges of the inner piece.

41. The article of headwear of claim 40, wherein the inner piece is secured to the crown portion with one of the rows of stitching extending substantially parallel to and proximate one of the longitudinal folded edges of the inner piece.

42. The article of headwear of claim 32, wherein the binding is secured to the inner piece with adhesive.

43. The article of headwear of claim 32, wherein the sweatband is secured to the crown with adhesive.

44. The article of headwear of claim 32, wherein the binding of elastic material is secured to the inner piece such that it covers the seam.

45. A sweatband having an adjustable configuration comprising, in combination:

an inner piece formed of stretchable fabric material in an unfolded condition having opposed longitudinal edges and folded about itself such that the opposed longitudinal edges of the inner piece are proximate one another to form a seam; and a binding of elastic material secured to an outer side of the folded inner piece having the seam.

46. The sweatband of claim 45, further comprising a filler piece of elastic material, the inner piece of stretchable fabric material being folded about the filler piece of elastic material.

47. The sweatband of claim 45, wherein the binding of elastic material is secured to the inner piece such that it covers the seam.

48. The sweatband of claim 45, wherein the binding is secured to the inner piece with stitching.

49. The sweatband of claim 45, wherein the binding is secured to the inner piece with adhesive.

* * * * *